United States Patent [19]

Santilli et al.

[11] Patent Number: 4,865,937

[45] Date of Patent: Sep. 12, 1989

[54] METHOD OF MAKING FLUORESCENT TONER

[75] Inventors: Domenic Santilli, Webster; John W. May, Rochester, both of N.Y.

[73] Assignee: Eastman Kodak Company, Rochester, N.Y.

[21] Appl. No.: 248,700

[22] Filed: Sep. 26, 1988

[51] Int. Cl.[4] ..... G03G 9/12

[52] U.S. Cl. ..... 430/137; 430/106; 430/138; 430/114; 252/301.34; 252/301.35; 427/213.31

[58] Field of Search ..... 430/137, 138; 252/301.34, 301.35; 427/213.31

[56] References Cited

U.S. PATENT DOCUMENTS 3,779,924 12/1973 Chechak ..... 430/137
4,120,805 10/1978 Yamashita et al. ..... 430/115
4,473,630 9/1984 Yokoya et al. ..... 430/114
4,724,094 2/1988 Song ..... 252/301.35 X

FOREIGN PATENT DOCUMENTS 2508095 8/1975 Fed. Rep. of Germany ..... 430/137
62-1777 1/1987 Japan ..... 252/301.34

*Primary Examiner*—Roland E. Martin
*Attorney, Agent, or Firm*—Bernard D. Wiese

[57] ABSTRACT

Disclosed is a method of making a fluorescent toner for use in electrostatography and a fluorescent toner and developer made by that method. A solution is prepared which comprises an organic solvent, a fluorescent dye, and an organic polymer. A pigment is precipitated by mixing the solution with a non-solvent for the polymer in the presence of a dispersant. The pigment is melt compounded with a polymeric organic binder and the melt compounded mixture is comminuted.

16 Claims, No Drawings

METHOD OF MAKING FLUORESCENT TONER

FIELD OF THE INVENTION

This invention relates to a method of making a fluorescent toner for use in electrostatography, and to toners and developers made by that method. More specifically, it relates to such a method where a fluorescent pigment is precipitated by mixing a solution of a fluorescent dye and an organic polymer with a non-solvent in the presence of a dispersant, and the pigment is melt compounded with a polymeric organic binder, then comminuted.

BACKGROUND

In electrostatography a latent electrostatic image is formed on an insulating substrate such as a photoconductor. This image can be formed by a variety of methods including the use of light of visible or non-visible (e.g., x-ray) wavelength, or electronically by electrographic recording. imagewise charge patterns can also be made by other electrostatographic means such as ionography and ion projection. The latent electrostatic image can be developed (i.e., made visible) by the application of a developer containing charged colored particles, called toner particles, to the latent image. The charged toner particles adhere to the latent image in proportion to the imagewise potential difference. The developer can be either a dry powder or dispersed toner particles in an electrically insulating liquid.

While it is not necessary for toners used in many electrostatographic processes to be fluorescent, fluorescent toners are very advantageous if the toners are to be used in xeroradiography. (See, for example, U.S. Pat. Nos. 2,817,767 and 2,856,535.) Briefly, in xeroradiography, a charged photoconductor is exposed to x-rays which have passed through an object (e.g., a portion of a human body) of which one wishes to obtain an x-ray image, forming a latent electrostatic x-ray image on the photoconductor. The latent image is toned with a fluorescent toner and the toned image is exposed to light. The image fluoresces in proportion to the amount of fluorescent toner that is present and can be photographed or used to expose a photoconductor for xerographic copying. The use of a fluoroescent dye in this process enhances the contrast of the image and reduces the intensity of the x-rays needed to form the image.

Fluorescent toners can also be advantageous when image detection differs from the conventional viewing of optical density in transmission or reflection. For example, fluorescent toners can be useful in security applications requiring a specialized readout wavelength, or as hidden marker images, such as on banknotes.

Since fluorescent dyes do not themselves have properties that toners must have to develop an electrostatic latent image, a fluorescent toner must be made by incorporating a fluorescent dye into a polymeric binder (with other components). We have found, however, that when certain fluorescent dyes are directly mixed with suitable binders by melt compounding and grinding, the most common method of preparing a toner, the electrical properties of the toner are disturbed, so that images formed with the toner are of poor quality. Moreover, if the toner formulation is optimized for a particular dye, the formulation may not be optimum for a different dye.

If the fluorescent dye is not melt compounded with the binder, but is merely mixed with it, the dye may not fluoresce, or may not fluoresce well, because it is not in solid solution in the binder. While a solid solution of the dye can be made by forming a solution of the binder and the dye and removing the solvent, this procedure cannot be used when the binder is insoluble or is not soluble in commonly used or non-toxic solvents. Also, toners prepared in this manner may have inferior properties, such as unstable charging characteristics, compared to toners prepared by melt compounding.

In addition to maintaining the electrical properties of the toner and the fluorescence of the dye, a procedure for making a fluorescent toner should also be capable of producing a toner of small particle size (e.g., less than a micrometer for liquid toners and less than 20 micrometers for dry toners), since high resolution images require smaller sized toners. If a pigment particle is to be incorporated into a toner particle without substantially altering its characterstics, the pigment particle must be small enough, relative to the toner particle, so that its properties do not significantly perturb the properties of the particle as a whole. A good procedure for making a fluorescent toner should therefore make or use small pigment particles (e.g., less than one micrometer).

SUMMARY OF THE INVENTION

We have discovered that fluorescent dyes can be incorporated into toners without adversely affecting the electrical properties of the toner or the fluorescence of the dye if the dye is first made into a fluorescent pigment, and then the pigment is melt compounded with the toner binder. (Herein, "pigment" means a fluorescent phase, separate from the binder, in which a fluorescent dye is dissolved in an organic polymer. "Fluorescent" means emitting light after excitation and may include luminescent, phosphorescent, and scintillating.) The pigment is prepared by mixing a solution of the dye and an organic polymer with a non-solvent in the presence of a dispersant. This procedure precipitates submicrometer sized pigment particles, which can be incorporated into small toner particles without substantially altering the electrical surface characteristics of the toner particles. This method also reduces energy usage since energy intensive mechanical grinding need not be used to produce the small pigment particles. The method of this invention permits a wider selection of toner binders for making fluorescent toners than was previously feasible because the fluorescent molecules are not required to be in solid solution in the binder. We have further found that rhodamine dyes fluoresce particularly well when in solid solution with cellulosic polymers.

DESCRIPTION OF THE PREFERRED EMBODIMENTS

In the first step of the process of this invention, a solution is prepared which comprises an organic solvent, a fluorescent dye, and an organic polymer. The concentrations of dye and polymer in the solution are preferably near or at their saturation levels in the solvent. The saturation levels will depend upon the particular materials selected. A typical weight ratio of dye to polymer in the solution is about 0.001 to about 0.05. More dye may cause the dye to crystallize inside the pigment which may result in a loss of fluorescence, and less dye may not produce a very fluorescent toner. The total amount of dye plus polymer in the solution is typically about 1 to about 20% by weight of the solution weight, as a higher concentration may result in pigment particles that are too large to be easily melt compounded, and a lower concentration may product pigment particles that are too small to be easily isolated.

Any organic solvent in which the dye and polymer will dissolve can be used in forming the solution. Examples of organic solvents that may be suitable, depending upon the particular dye and polymer selected, include 2-vinyl pyrrolidone, N-methyl pyrrolidone, glycol ethyl ether, hydroxyethyl acetate glycol monoacetate, ethyl acetate, diethyl ether, dimethyl formamide, dimethylacetamide, ethyl alcohol, acetone, methyl isobutyl ketone, methyl ethyl ketone, sulfolane, benzene, toluene, xylene, and dichloromethane. Acetone is preferred because it is a particularly good solvent for cellulosic polymers.

The organic polymer must be soluble in the solvent and, when it precipitates with the dye, must form a solid solution with the dye. An advantage of this invention is that polymers that are infusible at a low temperature (e.g., below about 200° C.), or that cannot be easily ground, such as cellulose and high molecular weight polymers, can be used to form the pigment. Examples of other suitable polymers include polyesters, vinylic and acrylic addition-type polymers and copolymers, hydroxy polyvinyl polymers, and polyvinyl alcohol and esters thereof. Cellulosic polymers are preferred because rhodamine dyes, the preferred dyes, fluoresce more with cellulosic polymers. Examples of suitable polymers having a cellulosic structure include

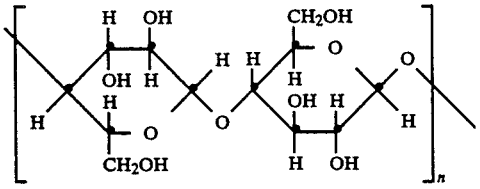

Cellulose

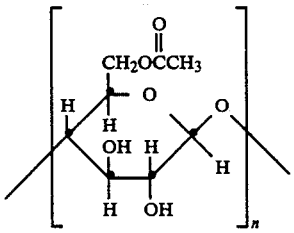

Cellulose Acetate

-continued

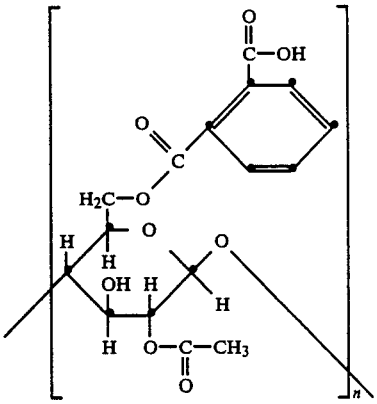

Cellulose Acetate Phthalate ("CAP")

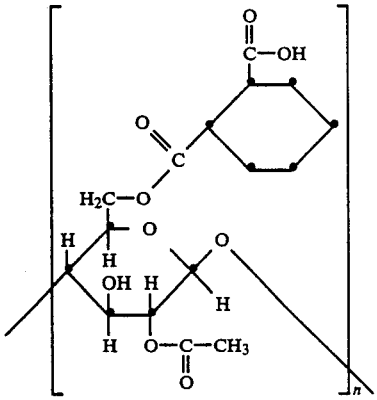

Cellulose Acetate Hexahydrophthalate ("CAP-6")

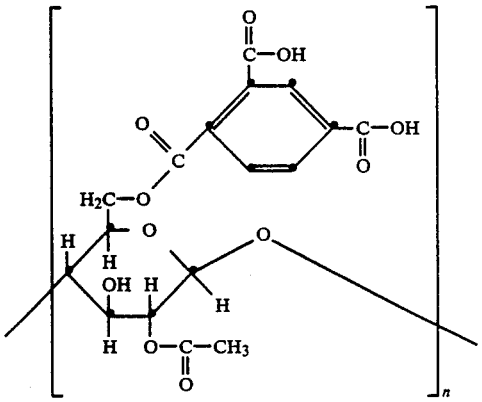

Cellulose Acetate Trimillitate ("CAT")

-continued

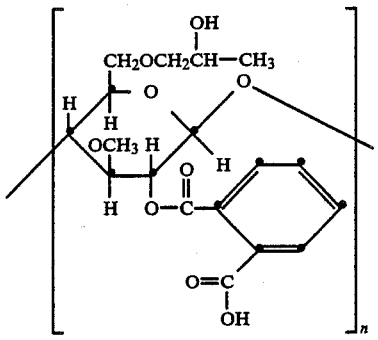

Hydroxypropyl Methyl Cellulose Phthalate

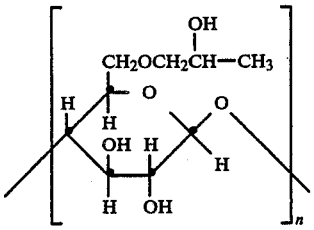

Hydroxypropyl Cellulose

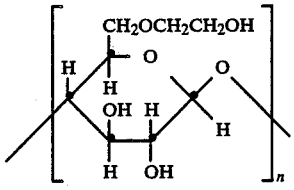

Hydroxyethyl Cellulose

The preferred cellulosic polymer is "CAP-6" because it is polar, which enables it to form a better molecular dispersion with cationic dyes such as rhodamine dyes, and to precipitate as smaller particles.

Any fluoescent dye which is soluble in an organic solvent and which will form a solid solution in the pigment with the organic polymer can be used in making the solution. Examples of fluorescent dyes include rhodamine dyes, rosaniline, and fluorescein dyes. Rhodamine dyes are preferred because of their high quantum efficiency in fluorescence. Examples of rhodamine dyes include Rhodamine 6G (C.I. 45160), Rhodamine 6G Perchlorate, Rhodamine 6G Tetrafluoroborate, Rhodamine B (C.I. 45170), Rhodamine 3B Perchlorate, Rhodamine S (C.I. 45050), Rhodamine 19 Perchlorate, Rhodamine 101 Inner Salt, Rhodamine 110, Rhodamine 116, Rhodamine 123, and Solvent Rhodamine B conc. (C.I. 45170B). The preferred rhodamine dyes are the Rhodamine triflates, which are the trifluoromethane sulfonate salts of the rhodamine dyes, because of their high fluorescence efficiency. (See. U.S. Pat. No. 4,711,832.) Especially preferred is the triflate of the methyl ester of Rhodamine B.

In the second step of the method of this invention, a fluorescent pigment is precipitated by mixing the solution of the solvent, organic polymer, and fluorescent dye with a non-solvent in the presence of a dispersant. The dispersant performs the function of preventing the precipitating pigment particles from agglomerating or coalescing. If the dispersant is not present large pigment particles are formed which cannot be used without grinding, and grinding significantly adds to the cost of preparing a toner, especially with polymers such as cellulose, which cannot be easily ground. The dispersant must be in solution, but can be dissolved in either the solvent or the non-solvent for the polymer; it is preferably dissolved in the solvent along with the polymer and the dye, as that requires less dispersant and may result in smaller pigment particles. The dispersant must be soluble in the solvent, but dispersants which are not readily soluble in the solvent can sometimes be used if they are predissolved in another solvent, such as dichloromethane, that is miscible with the solvent from which precipitation of the pigment occurs. The dispersant should also be soluble in the non-solvent so that it can be easily separate from the pigment when the pigment is precipitated. The concentration of dispersant in the solution should be sufficient to prevent the precipitated pigment particles from agglomerating to a particle size greater than 1 μm; preferably, the particles have a particle size of less than 0.1 μm because for liquid developers it is desirable to prepare toner particles that are not much larger. Particles of that size can generally be obtained by using a weight ratio of dispersant to dye plus polymer in the solution of about 0.1 to about 2. More dispersant is difficult to dissolve and serves no useful purpose, and less dispersant may result in pigment particles that are too large. Surfactants or charge control agents that cause the precipitating pigment particles to repel so that they do not agglomerate into large particles can be used as dispersants. Examples of non-polymeric dispersants include salts of such fatty acids as stearic acid, palmitic acid, and lauric acid. Polymeric dispersants are preferred because they usually have better long term stability. Examples of polymeric dispersants include poly(sytrene-co-lauryl methacrylate-co-sulfoethyl methacrylate), poly(vinyltoluene-co-lauryl methacrylate-co-lithium methacrylate), poly(styrene-co-lauryl methacrylate-co-lithium methacrylate), poly(t-butylstyrene-co-styrene-co-lithium sulfoethyl methacrylate), poly(t-butylstyrene-co-lauryl methacrylate-co-lithium methacrylate), poly(t-butylstyrene-co-lithium methacrylate), poly(t-butylstyrene-co-lauryl methacrylate-co-lithium methacrylate-co-methacrylic acid), and poly(vinyltoluene-co-lauryl methacrylate-co-methacryloyloxyethyltrimethylammonium p-toluenesulfonate). (See U.S. Pat. Nos. 4,708,923 and 3,788,995, herein incorporated by reference.) The preferred polymeric dispersants are poly(t-butyl-styrene-co-lithium methacrylate) and poly(t-butyl-styrene-co-lithium methacrylate) and poly(t-butyl-styrene-co-styrene-co-lithium sulfoethyl methacrylate) because they have been found to work well.

The non-solvent is a non-solvent for the polymer and the dye, but is a solvent for the dispersant. Examples of liquids which may be useful as non-solvents, depending upon the particular polymer, dye, and dispersant used, include water, alkanes such as butane, pentane, hexane, and heptane, and mixtures of alkanes. The preferred non-solvent is heptane because it evaporates quickly. A sufficient amount of non-solvent must be used to precipitate the pigment. Since the dispersant remains in solution it can be separated from the pigment so that it does not contaminate or dilute the pigment. Separation can be accomplished by, for example, filtration or centrifugation; filtration is preferred. The pigment comprises the dye in solid solution with the polymer (i.e., the dye is molecularly dispersed in the polymer, forming a continuous phase with it). For many dyes, such as the rhodamine dyes, a solid solution is required in order to achieve fluorescence. No chemical reaction occurs between the dye and the polymer in forming the pigment because separation of the dye from the polymer can be achieved by physical means such as, for example, dissolution of the pigment in a solvent followed by precipitation of the polymer by addition of a liquid that is a non-solvent for the polymer but a sovlent for the dye.

In the third step of the method of this invention, the pigment is melt compounded with a polymeric organic binder. Merely mixing the pigment with the binder does not produce a good toner because the charge on the toner is less stable and fluctuates with relative humidity, resulting in a wide variance in image quality. Melt compounding consists of mixing the pigment and the binder together at a temperature sufficient to soften or melt the binder, as is well known in the art. The pigment should be about 10 to about 60% by weight of the mixture, based on the total solids weight. The toner binder must be thermoplastic if a fusible toner is to be obtained. The toner binder preferably has a glass transition temperature, $T_g$, of about 40 to about 100° C., and most preferably about 45 to about 65° C., as a lower $T_g$ may result in a clumping of the toner as it is handled at room temperature, while a higher $T_g$ renders the process of this invention too energy intensive. Preferably, dry toner particles have a relatively high caking temperature, for example, higher than about 60° C., so that the toner powders can be stored for relatively long periods of time at fairly high temperatures without individual particles agglomerating and clumping together.

The melting point of polymers useful as toner binders preferably is about 65° C. to about 200° C. so that the toner particles can be readily fused to a receiver to form a permanent image. Especially preferred polymers are those having a melting point of about 65° to about 120° C. The polymers useful as toner binders in the practice of the present invention can be used alone or in combination and include those polymers conventionally employed in electrostatographic toners. Among the various polymers which can be employed as binders in the present invention are polycarbonates, resin-modified maleic alkyd polymers, polyamides, phenolformaldehyde polymers and various derivatives thereof, polyesters condensates, modified alkyd polymers, aromatic polymers containing alternating methylene and aromatic units such as described in U.S. Pat. No. 3,809,554, and fusible crosslinked polymers as described in U.S. Pat. No. Re 31,072.

Typical useful binder polymers include certain polycarbonates such as those described in U.S. Pat. No. 3,694,359, which include polycarbonate materials containing an alkylidene diarylene moiety in a recurring unit and having from 1 to about 10 carbon atoms in the alkyl moiety. Other useful binder polymers having the above-described physical properties include addition polymers of acrylic and methacrylic acid such as poly(alkyl acrylate), and poly(alkyl methacrylate) wherein the alkyl moiety can contain from 1 to about 10 carbon atoms. Additionally, polyesters having the aforementioned physical properties are also useful. Among such useful polyesters are copolyesters prepared from terephthalic acid (including substituted terephthalic acid), a bis(hdyroxyalkoxy)phenylalkane having from 1 to 4 carbon atoms in the alkoxy radical and from 1 to 10 carbon atoms in the alkane moiety (which can also be a halogen-substituted alkane), and an alkylene glycol having from 1 to 4 carbon atoms in the alkylene moiety.

Other useful binder polymers are various styrene-containing polymers. Such polymers can comprise, e.g., a polymerized blend of from about 40 to about 100 percent by weight of styrene, from 0 to about 45 percent by weight of a lower alkyl acrylate or methacrylate having from 1 to about 4 carbon atoms in the alkyl moiety such as methyl, ethyl, isopropyl, butyl, etc. and from about 5 to about 50 percent by weight of another vinyl monomer other than styrene, for example, a higher alkyl acrylate or methacrylate having from about 6 to 20 or more carbon atoms in the alkyl group. Typical styrene-containing polymers prepared from a copolymerized blend as described hereinabove are copolymers prepared from a monomeric blend of 40 to 60 percent by weight styrene or styrene homolog, from about 20 to about 50 percent by weight of a lower alkyl acrylate or methacrylate and from about 5 to about 30 percent by weight of a higher alkyl acrylate or methacrylate such as ethylhexyl acrylate (e.g., styrene-butyl acrylateethylhexyl acrylate copolymer). Preferred fusible styrene copolymers are those which are covalently crosslinked with a small amount of a divinyl compound such as divinylbenzene. A variety of other useful styrene-containing toner materials are disclosed in U.S. Pat. Nos. 2,917,460; Re 25,316; 2,788,288; 2,638,416; 2,618,552 and 2,659,670. Preferred toner binders are homopolymers and copolymers of styrene or a derivative of styrene and an acrylate, preferably butylacrylate.

Useful toner binders can simply comprise the polymeric binder particles but it is often desirable to incorporate addenda in the binder such as waxes, colorants, release agents, charge control agents, and other toner addenda well known in the art.

Dry toner particles can also incorporate magnetic material so as to form what is sometimes referred to as a "single component developer." A "two component developer" can also be made, where the toner particles are simply mixed with carrier particles.

In the final step of the process of this invention, the melt compounded mixture of the pigment and the toner binder is comminuted to the desired particle size. A liquid developer can be prepared, for example, by coarse pulversing followed by milling the coarse grind to a sub-micrometer particle size in an organic liquid non-solvent, which can also contain a charge control agent and other components as desired. A dry toner can be prepared, for example, by jet grinding the melt compounded mixture, which produces a toner having a particle size of about 5 to about 15 μm. Liquid developers are preferred as they generally produce images having better grain quality that do dry toners.

The fluorescent toners of this invention can be used in various types of electrostatographic copy machines. They are particularly useful in xeroradiography but they can also be used in making fluorescent displays and other uses where fluorescence is desirable. The fluorescent toners are also useful in making secure copies (i.e., copies that cannot be copied) if the dyes selected fluoresce at a wavelength that does not activate the photoconductor of the copier.

The following examples further illustrate this invention.

PIGMENT PREPARATION EXAMPLES

Example 1

Comparative Example

This example is outside the scope of this invention because no dispersant was present; if shows that large size pigment particles are obtained in the absence of a dispersant.

Into 250 ml dichloromethane was dissolved 25.0 grams of a polyester made from 53 mole percent methacryloyloxyethylacetoacetamide, 43 mole percent terephthalic acid, 4 mole percent sodium salt of 1,3-dimethyl 5-sulfoisophthalate (preceding mole percentages based on total acid portion of the polyester), and 100 mole percent neopentylglycol (based on total hydroxyl portion of the polyester). To the solution was added 0.50 grams of a navy blue polyester dye, 3-acetamide-4-N,N-di-(2-methoxycarbonylethylamino)-5-methoxy-2',4'-dinitro-6'-bromoazobenzene, and the mixture was stirred until the dye dissolved. The mixture was poured into 2000 ml heptane, a non-solvent for the polyester, while stirring. Blue spherical beads measuring up to 10 μm in diameter precipitated. The beads could be isolated by centrifugation or filtration.

EXAMPLE 2

Example 1 was repeated except that 5.0 g of a dispersant (a copolymer of 97 weight percent 4-t-butylstyrene-3 weight percent lithium methacrylate), was added to the solution before the solution was added to the heptane. Blue beads of pigment, which consisted of the dye in solid solution with the polyester, measuring 0.2 to 0.3 μm in diameter, precipitated.

EXAMPLE 3

Comparative Example

This example is outside the scope of this invention because no dispersant was present; it shows that large size pigment particles are obtained in the absence of a dispersant.

Into 700 ml acetone was dissolved 35.0 grams "CAP-6," and 0.3 g of Rhodamine 6G was added while stirring. This solution was added to 2000 ml heptane. A very coarse fibrous-like precipitate was obtained. The size of the particles was not measured but was clearly greater than 10 μm.

EXAMPLE 4

Into 700 ml acetone was dissolved 35.0 g "CAP-6"; 0.33 g Rhodamine 6G was added and dissolved in the solution. To that solution was added 100.0 g of a 5 weight percent solution in dichloromethane of the dispersant used in Example 2. The mixture was then added to 200 ml heptane while stirring. Sub-micrometer sized pigment particles were obtained which were isolated by filtration.

EXAMPLE 5

Example 4 was repeated except that Rhodamine B was used instead of Rhodamine 6G. Sub-micrometer sized pigment particles were obtained and were isolated by filtration.

TONER PREPARATION EXAMPLES

EXAMPLE 6

Ten grams of the pigment made in Example 4 were melt compounded with 20.0 g of the polyester described in Example 1, 5.0 g polyethylene wax sold by Eastman Kodak Co. under the trade designation "Epolene E-12," and 5.0 g copolymer of 78 mole percent ethylene and 22 mole percent vinyl acetate (to make the polyethylene wax compatible), sold by Dupont under the trade designation "Elvax 210." The thermoplastic mixture was pulverized and 10.0 g of the resulting dry toner was ball milled with 10.0 g of a charge agent which was a copolymer of 72 weight percent 4-t-butylstyrene—24 weight percent styrene —4 weight percent lithium sulfoethyl methacrylate and 4.0 g of the dispersant used in Example 2 in 83.0 g of a mixed alkane ($C_8$ to $C_{13}$) solvent sold by Exxon under the trade designation "Isopar-G." The toner particle size was less than one micrometer, but the toner particles were larger than the pigment particles. An electrographic liquid developer was prepared by diluting an aliquot of the mill grind in one liter of "Isopar-G" to obtain a toner solids concentration of 4 g/L. The developer was tested in a conventional xerographic process and image quality was excellent. The fluorescence of the image was bright, useful, and satisfactory.

EXAMPLE 7

Comparative Example

This example is outside the scope of this invention because no pigment was prepared; it shows that if the dye is directly melt compounded with the toner binder a poor quality toner is obtained.

The following compositions were melt compounded on a heated (130° C.) two roll mill for about 20 minutes:

| | Composition (g) | | | |
|---|---|---|---|---|
| | A | B | C | D |
| Polyester of Example 1 | 50 | 50 | 50 | 50 |
| Triflate of the methyl ester of Rhodamine B | 0.3 | 0.6 | — | — |
| Rhodamine 6G | — | — | 0.25 | 0.75 |
| "Epolene E-12" | 12.5 | 12.5 | 12.5 | 12.5 |
| "Elvax 210" | 12.5 | 12.5 | 12.5 | 12.5 |

Twenty grams of each melt compounded composition was ball milled for 3 days on a vibratory mill with 20.0 g of the charge agent described in Example 6 and 138 g of "Isopar-G." Then 16.0 g of te dispersant of Example 2 and 64 g "Isopar-G" were added and the milling was continued for one more day. Toner particle size was less than one micrometer. Liquid developers were prepared by diluting with "Isopar-G" to a concentration of 8.0 g toner solids per liter. The liquid developers were tested as in Example 6. The resulting images were of low density and there was some degree of toner smearing, which indicated that the dyes had adversely affected the electrical properties of the toner.

EXAMPLE 8

Following the procedure of Example 2, Pigment A was prepared from 98.0 g "CAP-6," 2.0 g of the triflate of the methyl ester of Rhodamine B, and 5 g of the dispersant used in Example 2; similarly, Pigment B was prepared from 90 g "CAP-6," 10 g Rhodamine 6G, and 5 g of the dispersant used in Example 2. Both pigments were of sub-micrometer particle size. The following compositions were melt compounded as in Example 7:

| | Composition (g) | |
|---|---|---|
| | E | F |
| Polyester of Example 1 | 30 | 30 |
| Pigment A | 20 | — |
| Pigment B | — | 20 |
| "Epolene E-12" | 8.0 | 8.0 |
| "Elvax 210" | 8.0 | 8.0 |

Liquid developers were prepared from Compositions E and F and tested as in Example 7. Toner particle size was less than one micrometer but was larger than the pigment particle size. The images were of excellent quality and were very dense. The fluorescence of each image was bright, useful, and satisfactory.

The invention has been described in detail with particular reference to preferred embodiments thereof, but it will be understood that variations and modifications can be effected within the spirit and scope of the invention.

What is claimed is:

1. A method of making a fluorescent toner for use in electrostatography comprising (I) preparing a solution which compries (A) organic solvent;

(B) a fluoroescent dye soluble in said solvent; and (c) an organic polymer soluble in said solvent;

(II) mixing said solution with a sufficient amount of a liquid which is a non-solvent for said polymer to precipitate particles of a pigment which comprises said dye in solid solution with said polymer, said mixing being in the presence of a dispersant soluble in said non-solvent in an amount sufficient to prevent said precipitating pigment particles from agglomerating to a particle size greater than 1 μm;

(III) melt compound a mixture which comprises polymeric organic binder and said pigment; and (IV) comminuting said melt compounded mixture.

2. A method according to claim 1 wherein the weight ratio of said dye to said polymer in said solution is about 0.001 to about 0.05, and the total amount of said dye plus said polymer in said solution is about 1 to about 20% by weight of said solution weight.

3. A method according to claim 1 wherein said pigment is about 10 to about 60% of the weight of said mixture.

4. A method according to claim 1 wherein said dye is a rhodamine dye.

5. A method according to claim 4 wherein said rhodamine dye is a rhodamine triflate.

6. A method according to claim 5 wherein said rhodamine triflate is the triflate of the methyl ester of Rhodamine B.

7. A method according to claim 4 wherein said polymer is a cellulosic polymer.

8. A method according to claim 7 wherein said solvent is acetone.

9. A method according to claim 1 wherein said solution is saturated with said polymer and said dye.

10. A method according to claim 1 wherein the weight ratio of said dispersant to said dye plus said polymer is about 0.1 to about 2.

11. A method according to claim 1 wherein said dispersant is polymeric.

12. A method according to claim 11 wherein said dispersant is a copolymer of t-butylstyrene and lithium methacrylate.

13. A method according to claim 1 wherein said liquid is heptane.

14. A method according to claim 1 wherein said melt compounded mixture is comminuted by coarse pulverizing followed by milling in a liquid.

15. A method according to claim 1 wherein said melt compounded mixture is comminuted to a particle size of about 5 to about 15 μm by jet grinding.

16. A method according to claim 1 wherein said pigment particle size is less than 0.1 μm.

* * * * *